US012331930B1

(12) United States Patent
Moore

(10) Patent No.: US 12,331,930 B1
(45) Date of Patent: Jun. 17, 2025

(54) INTERRUPTION OF METHANE FLOW TO PROCESS HEATING SYSTEMS RESPONSIVE TO FLAME LOSS

(71) Applicant: Derek L. Moore, Greeley, CO (US)

(72) Inventor: Derek L. Moore, Greeley, CO (US)

( * ) Notice: Subject to any disclaimer, the term of this patent is extended or adjusted under 35 U.S.C. 154(b) by 0 days.

(21) Appl. No.: 19/049,903

(22) Filed: Feb. 10, 2025

Related U.S. Application Data

(60) Provisional application No. 63/552,573, filed on Feb. 12, 2024.

(51) Int. Cl.
*F23N 5/10* (2006.01)
*F23N 5/24* (2006.01)

(52) U.S. Cl.
CPC ..... *F23N 5/105* (2013.01); *F23N 5/245* (2013.01); *F23N 2229/02* (2020.01); *F23N 2231/08* (2020.01)

(58) Field of Classification Search
CPC ..... F23N 5/105; F23N 5/245; F23N 2231/08; F23N 2229/02; F23N 2235/16; F23N 1/007
USPC ..... 431/12, 18–90
See application file for complete search history.

(56) References Cited

U.S. PATENT DOCUMENTS

2023/0024790 A1* 1/2023 Moore ..... F23G 7/08

* cited by examiner

*Primary Examiner* — Vivek K Shirsat
(74) *Attorney, Agent, or Firm* — Samuel M. Freund; Cochran Freund & Young LLC

(57) ABSTRACT

A low cost, pneumatic, thermo-electric apparatus and method capable of controlling both a pilot gas burner and a main heating gas burner for ensuring cessation of fugitive methane emissions from process heating systems upon loss of the pilot flame, without requiring external electricity, are described.

8 Claims, 4 Drawing Sheets

FIG. 1 "PRIOR ART"

INTERRUPTION OF METHANE FLOW TO PROCESS HEATING SYSTEMS RESPONSIVE TO FLAME LOSS

CROSS-REFERENCE TO RELATED APPLICATIONS

The present application claims the benefit of U.S. Provisional Patent Application No. 63/552,573 for "Interruption of Methane Flow to Process Heating Systems Responsive to Flame Loss" which was filed on 12 Feb. 2024, the entire content of which application is hereby specifically incorporated by reference herein for all that it discloses and teaches.

BACKGROUND

Methane or natural gas is utilized to provide fuel in pneumatic process heating systems in the oil and gas industry during the extraction process of natural gas and oil. On the surface, production equipment is utilized to separate hydrocarbons, methane, and water, where in some instances, heat is required to better accomplish these separations. Using the produced methane, pneumatically driven/operated natural gas burners are included in the separation equipment to provide temperatures at which the greatest separation of the oil and water may be achieved. In most situations, a main burner and a pilot burner are utilized for this purpose; however, there are rarely controls to stop the release of raw/unburned pilot burner and main burner gas in the event of pilot flame loss due to pilot orifice blockage, pilot orifice freezes, pilot loss from wind, etc., where methane will continue to flow through both the pilot and main burner orifices into the atmosphere, in some situations for days.

This problem cannot be rectified until the separator/supply runs out of gas, or in extreme events, until someone can access the separator which can be multiple days or even weeks, depending on frequency of site visits or extreme weather conditions limiting access to the equipment. One solution to this problem would be the installation of an electronic burner management system. However, the high costs of such systems, and/or lack of grid or solar access during winter days to electrical power, can cause operators of lower-profit well sites to simply assume that the pilot flame remains ignited as the best option.

SUMMARY

In accordance with the purposes of the present invention, as embodied and broadly described herein, an embodiment of the apparatus for ceasing methane flow from a high-pressure methane source to a gas heating system having an operating temperature, responsive to flame loss of a pilot methane gas burner, hereof, includes: a pneumatic gas regulator for receiving methane from the high-pressure methane source and for providing a first chosen pressure of methane; a primary pilot gas regulator for receiving methane from the high-pressure methane source and providing a second chosen pressure of methane; a thermostatic controller for measuring the temperature of the gas heating system, for receiving the first chosen pressure of methane, for providing an output pressure of methane that is equal to or below the second chosen pressure of methane when the gas heating system has a temperature above the operating temperature, and for providing an output pressure of methane above the second chosen pressure when the gas heating system has a temperature equal to or below the operating temperature; a pneumatic signal selector for receiving the output pressure of methane from the thermostatic controller, and the second chosen pressure of methane from the primary pilot gas regulator, the pneumatic signal selector having an output pressure of methane equal to the larger of the output pressure of methane from the thermostatic controller or the second chosen pressure of methane; a thermocouple in thermal contact with the pilot methane gas burner, the thermocouple providing a voltage responsive to a temperature generated when the pilot methane gas burner has a flame from burning methane; a thermo-electric valve for receiving the output pressure of methane from the pneumatic signal selector, for receiving the voltage from the thermocouple, for providing an output pressure of methane equal to the output pressure from the pneumatic signal selector, and for providing a control signal, when the voltage from the thermocouple is responsive to the temperature generated when the pilot methane gas burner has a flame from burning methane; a secondary pilot gas regulator for receiving the output pressure of methane from the thermo-electric valve, and for providing a third chosen pressure of methane for maintaining the flame of the pilot methane gas burner from burning methane; a burner gas regulator for receiving methane from the high-pressure methane source, and for providing a fourth chosen pressure of methane; a burner gas control valve for receiving the output pressure of methane from the pneumatic signal selector, for receiving the second chosen pressure of methane from the primary pilot gas regulator, for receiving the fourth chosen pressure of methane from the burner gas regulator, for receiving the control signal form the thermo-electric valve, and for providing a controlled flow of methane from the burner gas regulator through the burner gas control valve, the burner gas control valve having a diaphragm disposed between a first gas-tight chamber and a second gas-tight chamber, whereby the second chosen pressure of methane presses downward on the diaphragm, and the output pressure of methane from the pneumatic signal selector presses upward on the diaphragm with sufficient force such that a controlled flow of methane is provided when the pilot methane gas burner has a flame from burning methane; and a methane burner for receiving the controlled flow of methane from the burner gas control valve, and for generating heat for the gas heating system.

In another aspect of the present invention, and in accordance with its purposes as embodied and broadly described herein, an embodiment of the apparatus for ceasing methane flow from a high-pressure methane source to a gas heating system having an operating temperature, responsive to flame loss of a pilot methane gas burner, hereof, includes: a pneumatic gas regulator for receiving methane from the high-pressure methane source and providing a first chosen pressure of methane; a primary pilot gas regulator for receiving methane from the high-pressure methane source and providing a second chosen pressure of methane; a thermocouple in thermal contact with the pilot methane gas burner, the thermocouple providing a voltage responsive to a temperature generated when the pilot methane gas burner has a flame from burning methane; a thermo-electric valve for receiving the second chosen pressure of methane, for receiving the voltage from the thermocouple, for maintaining the flame of the pilot methane gas burner from burning methane, for providing an output pressure of methane equal to the second chosen pressure of methane when the voltage from the thermocouple is responsive to the temperature generated when the pilot methane gas burner has a flame from burning methane, and for providing an output pressure of methane lower than the second chosen pressure when the pilot methane gas burner loses its flame; a thermostatic controller for measuring the temperature of the gas heating system, for receiving the first chosen pressure of methane, for providing an output pressure of methane below the first chosen pressure of methane when the gas heating system has a temperature above the operating temperature, and for providing an output pressure of methane equal to the first chosen pressure when the gas heating system has a temperature equal to or below the operating temperature; a pneumatic volume booster for receiving the output pressure of methane from the thermostatic controller, and the output pressure of methane from said thermo-electric valve, and for providing an output pressure; a burner gas regulator for receiving methane from the high-pressure methane source, and for providing a third chosen pressure of methane; a burner gas control valve for receiving output pressure of methane from the thermo-electric valve, for receiving the third chosen pressure of methane from the burner gas regulator, and for providing a controlled flow of methane from the burner gas regulator through the burner gas control valve, the burner gas control valve having a diaphragm disposed between a first gas-tight chamber and a second gas-tight chamber, whereby the output pressure of methane from the thermo-electric valve presses downward on the diaphragm, and the output pressure of methane from the thermostatic controller presses upward on the diaphragm with sufficient force such that a controlled flow of methane is provided when the pilot methane gas burner has a flame from burning methane; and a methane burner for receiving the controlled flow of methane from the burner gas control valve, and for generating heat for the gas heating system.

In yet another aspect of the present invention, and in accordance with its purposes as embodied and broadly described herein, an embodiment of method for ceasing methane flow from a high-pressure methane source to a gas heating system having an operating temperature, responsive to flame loss of a pilot methane gas burner, hereof, includes: providing a first chosen pressure of methane, and a second chosen pressure of methane from the high-pressure methane source; providing a voltage responsive to a temperature of the pilot methane gas burner; measuring the temperature of the gas heating system; providing an output pressure of methane that is equal to or below the second chosen pressure of methane when the gas heating system has a temperature above the operating temperature, and providing an output pressure of methane above the second chosen pressure when the gas heating system has a temperature equal to or below the operating temperature; providing a control signal, when the voltage responsive to the temperature generated by the pilot methane gas burner indicates a flame from burning methane; providing a third chosen pressure of methane for maintaining the flame of the pilot methane gas burner from burning methane; providing a fourth chosen pressure of methane from the high-pressure methane source; and providing a controlled flow of methane to the gas heating system, when the pilot methane gas burner has a flame from burning methane, responsive to the second chosen pressure of methane, the fourth chosen pressure of methane, and the control signal.

Advantages of embodiments of the present invention include, but are not limited to, providing a low cost, zero external power, thermo-electro pneumatic apparatus for ensuring cessation of fugitive methane emissions from process heating systems, which include both a pilot burner and a main heating burner, upon loss of the pilot flame.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION

Briefly, embodiments of the present invention include a low cost, zero external power, thermo-electro pneumatic apparatus for ensuring cessation of fugitive methane emissions from process heating systems, which include both a pilot burner and a main heating burner upon loss of the pilot flame.

Figure 1:
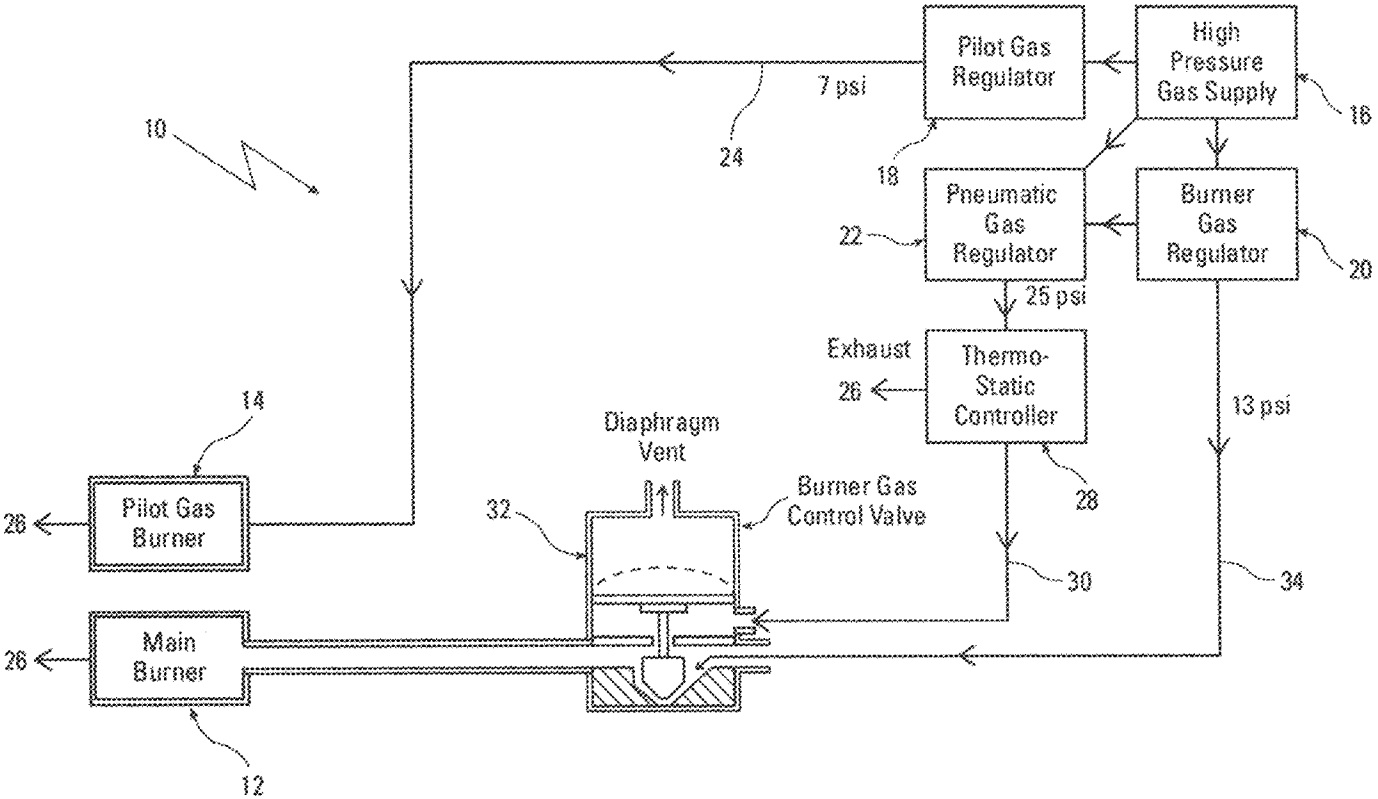
FIG. 1 is a schematic representation of an embodiment of a current apparatus for supplying methane to the main burner of a heating apparatus as well as to a pilot gas burner, labeled "PRIOR ART".

FIG. 1 is a schematic representation of an embodiment of a present apparatus, 10, for supplying methane to main burner, 12, of a heating apparatus as well as to pilot gas burner, 14. High pressure gas supply, 16, from the gas separation apparatus, not shown in FIG. 1, is utilized to supply gas to pilot burner 14 and also to main burner 16 for process heating. Pilot burner 14 maintains a flame for igniting main burner 16 when gas is flowing thereto. Most heat processing equipment provides no control over the pilot gas and main burner gas in the event of pilot gas flame loss. Individual regulators (pilot gas regulator, 18; burner gas regulator, 20; and pneumatic gas regulator, 22) downstream of high-pressure gas supply 16 are utilized to set the desired supply pressure to the pilot and main burners. The pilot gas set pressure, 24, is constant (shown as set to 7 psi) and therefore continues to send that pressure through the pilot orifice and into atmosphere, 26, upon flame loss. Another gas regulator is used to set desired pressure, shown as 25 psi, for the thermostatic controller, 28, for sending pneumatic operating signal, 30, to burner gas control valve, 32, which controls gas, 34, shown as 13 psi, to main burner 12 to provide heat when called upon. When the call for heat is satisfied, thermo-static controller 28 removes signal (vents to exhaust at atmospheric pressure 26) 30 and burner gas control valve 32 closes, resulting in the flame in main burner 12 being extinguished from lack of gas flow. Currently, when the flame is lost in pilot gas burner 14, if thermostatic controller 28 becomes unsatisfied based on the low temperature in main burner 12, signal 30 is again sent to burner gas control valve 32 from thermostatic controller 28, resulting in unburned gas 34 continuing to flow through main burner 12 into ambient atmosphere 26 until noticed, since main burner 12 can no longer be ignited by pilot gas burner 14.

Reference will now be made in detail to the present embodiments of the invention, examples of which are illustrated in the accompanying drawings. It will be understood that the FIGURES are presented for the purpose of describing particular embodiments of the invention and are not intended to limit the invention thereto. Similar or identical structures are labeled with identical callouts.

Figure 2:
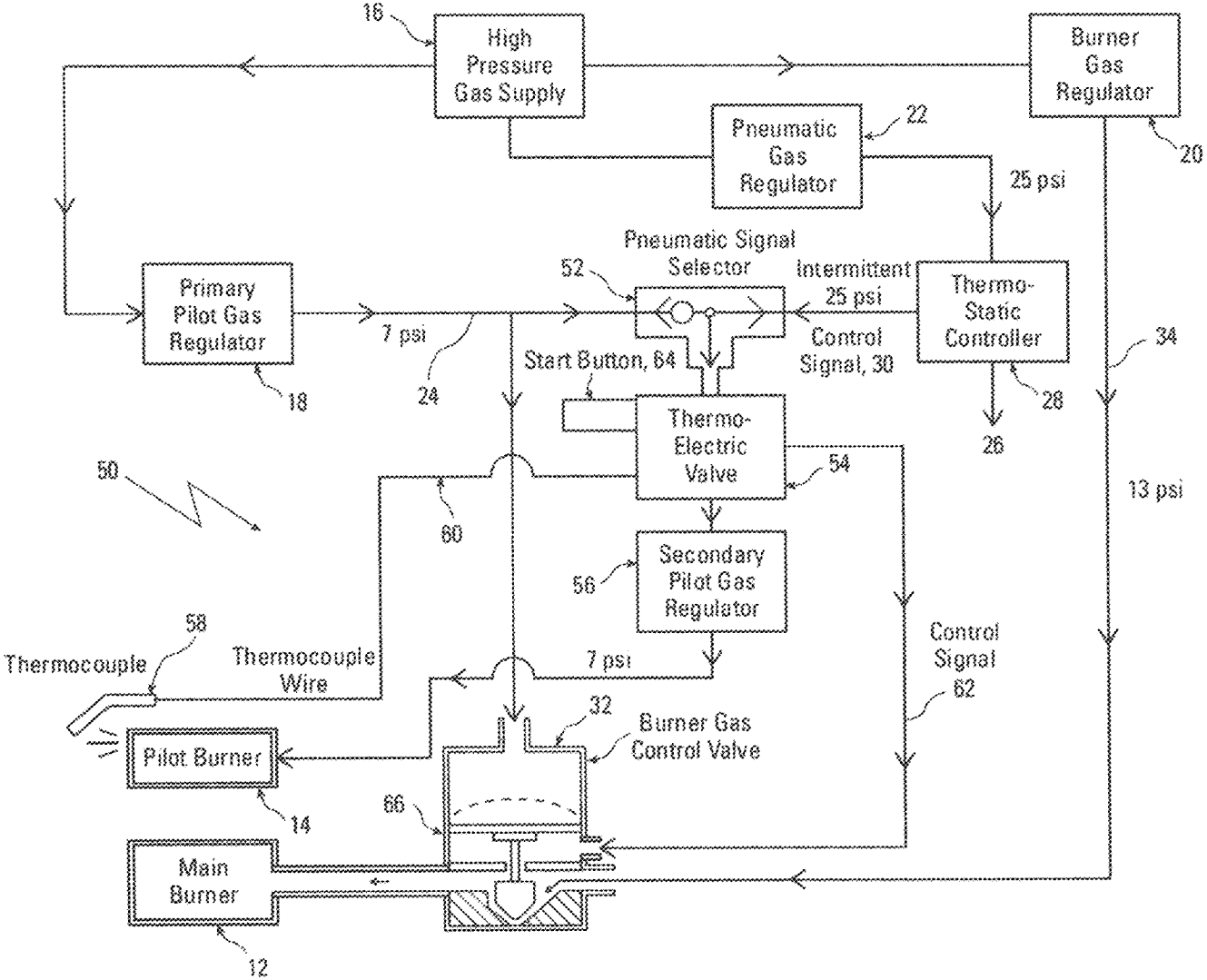
FIG. 2 is a schematic representation of an embodiment of the present invention, illustrating apparatus for interrupting the flow of methane to the main burner of a heating apparatus as well as to a pilot gas burner in the event of a loss of flame to the main burner and the pilot gas burner, employing a shuttle valve, or pneumatic signal selector.

Turning now to FIG. 2, shown is a schematic representation of an embodiment of the present invention, illustrating apparatus, 50, for interrupting the flow of methane to main burner 12 of a heating apparatus as well as to pilot gas burner 14, in the event of a loss of flame to the main burner and the pilot gas burner. As stated above, pilot burner 14 maintains a flame for igniting main burner 12 when gas is flowing thereto. Addition of pneumatic, high pressure signal selector, 52, in combination with fail-closed, thermo-electric gas valve, 54, and secondary pilot gas regulator, 56, to the existing pneumatic burner control system 10 of FIG. 1, permits main burner 12 to be indirectly controlled as well as the direct control of pilot burner 14, with both pilot and main burner gas being shut off in the event of pilot burner flame loss, with no external electricity needed to operate the system. Thermo-electric gas valve 54 is operated by thermocouple (or thermopile), 58, which generates the voltage for maintaining thermo-electric valve 54 in an open condition, and directs the voltage through thermocouple wire, 60, as long as pilot burner 14 is properly operating (burning methane), independent of whether thermostatic controller 28 remains satisfied or unsatisfied.

Figure 3:
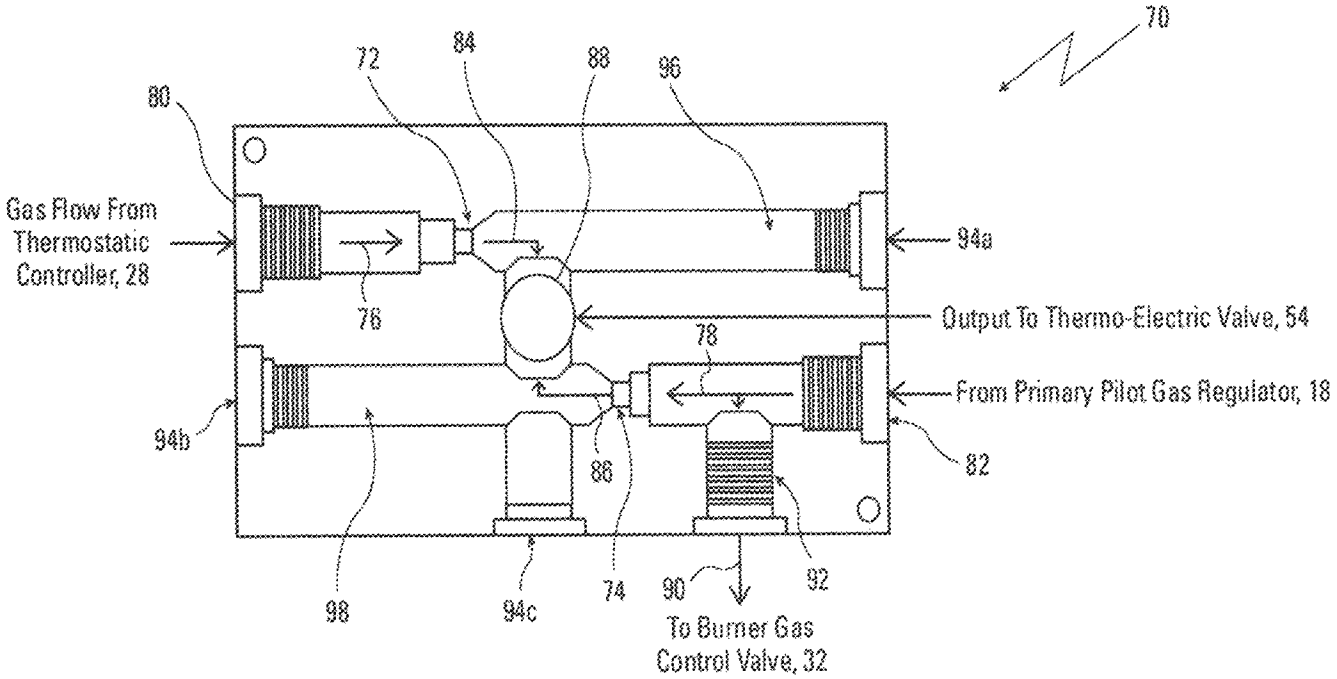
FIG. 3 is a schematic representation of another embodiment of the shuttle valve or pneumatic signal selector illustrated in FIG. 2, as a 2-port manifold employing check valves.

In operation, high-pressure gas supply 16 is regulated by burner gas regulator 20 to direct approximately 13 psi to burner gas control valve 32. Burner gas control valve 32 will not open unless it receives a pneumatic control signal, 62, from thermostatic controller 28 (from signal selector 52 responsive to control signal 30 from thermostatic controller 28 to thermo-electric valve 54). Signal selector 52, which also can be termed a shuttle valve, receives two input signals, one from thermostatic controller 28, and one from pilot gas regulator 18, and is commercially available. However, as will be discussed below, FIG. 3 illustrates a variation, 70, of the commercial shuttle valve which may also be utilized. Primary pilot gas regulator 18 provides an approximately constant 7 psi through commercially available thermo-electric valve 54 and secondary pilot gas regulator 56, for maintaining a constant pilot flame. The second signal is the on-demand control signal 30 from commercially available thermostatic controller 28. Pneumatic gas regulator 22 supplies about 25 psi to thermostatic controller 28, which can overcome the 7 psi from primary pilot gas regulator 18 to pneumatic signal selector 52 as control signal 30, when directed to do so by thermostatic controller 28. Once the 1 psi to 25 psi (as control signal 30, depending on the demand for heat experienced by thermostatic controller 28 responding to the main burner/heating system requirements) overcomes the 7 psi on the opposing side of pneumatic signal selector 52, thermo-electric valve 54, which when opened by a voltage from thermocouple 58, supplies control signal 62 to open burner gas control valve 32 a chosen amount, as well as supplying gas to retain the flame in pilot burner 14. Secondary pilot gas regulator 56 is provided following thermo-electric valve 54 to render the pressure (approximately 7 psi) in pilot burner 14 immune from the variable pressure from thermostatic controller 28. When thermostatic controller 28 is satisfied, the variable 25 psi signal from thermostatic controller 28 is removed, and the original 7 psi from primary pilot gas regulator 18 again continues to supply gas to the pilot burner 14.

As stated, thermo-electric valve 54 is a commercially available, 3-way valve having a start or bypass button, 64. In order to ignite the flame in pilot burner 14, start button 64 is depressed and held in the depressed condition until manually ignited pilot burner 14 remains lighted; that is, when thermocouple 58 achieves the correct temperature to open thermo-electric valve 54, start button 64 can be released. Thermo-electric valve 54 will remain in the open condition until and unless the thermocouple temperature drops below a value determined by the valve utilized, generally caused by the flame being extinguished, at which point thermo-electric valve 54 will automatically close, thereby stopping continuous flow of gas to pilot burner 14, which also removes pneumatic signal 62 from burner gas control valve 32 which closes the valve and stops the flow of main burner gas to main burner 12.

The thermo-electric valve employed possesses a flow interrupter, such that when start button 64 is depressed, flow is only directed to the pilot burner port.

For purposes of safety, thermo-electric valve start button 64 can be time-released, such that start button 64 can be located close to the control valves and away from pilot burner 14. If pilot burner 14 heats thermocouple 58 before the timer/spring releases, thermo-electric valve 54 will remain open; otherwise, thermo-electric valve 54 will close, and the flow of gas to pilot burner 14 will cease.

Approximately 7 psi is directed to pilot gas burner 14 in order, through pneumatic signal selector 52, thermoelectric valve 54, and secondary pilot gas regulator 56 to maintain the pilot flame. About 7 psi is also directed to the upper portion (above diaphragm, 66, which separates two airtight chambers of burner gas control valve 32) of burner gas control valve 32 for supplying additional downward pressure to diaphragm 66, since the cracking or opening pressure required without additional pressure above diaphragm 66 of burner gas control valve 32 is approximately 5 psi, whereas the cracking or opening pressure with the applied additional 7 psi signal is approximately 12 psi, which ensures that burner gas control valve 32 will close when the 25 psi control signal 62 to burner gas control valve 32 is no longer provided by thermostatic controller 28, while 7 psi (static) supply from primary pilot gas regulator 18 continues to press upward on diaphragm 66 of burner gas control valve 32 through thermo-electric valve 54 from primary pilot gas regulator 18 and pneumatic signal selector 52 as new control signal 62 (7 psi).

When directed by thermostatic controller 28, pneumatic gas regulator 22 sends approximately 25 psi of gas to burner gas control valve 32 in turn through thermostatic controller 28, pneumatic signal selector 52 and thermo-electric valve 54, causing main burner gas control valve 32 to open and send fuel gas for main burner 12 to burn. When the temperature of the heating system (not shown in FIG. 2) is satisfied, thermostatic controller 28 reduces control signal 30 to sufficiently below about 7 psi (from about 25 psi), pneumatic signal selector 52 responds by directing about 7 psi from primary gas regulator 18 to thermo-electric valve 54, which reduces control signal 62 to about 7 psi, effectively shutting off burner gas control valve 32, and venting the resulting gas to atmosphere 26. Since gas cannot return to thermostatic controller 28 through pneumatic signal selector 52, signal gas 62 that is "trapped" between pneumatic signal selector 52 and burner gas control valve 32 will be utilized by pilot burner 14 through thermo-electric valve 54 and secondary pilot gas regulator 56 until pressure equalizes at about 7 psi, after which pilot gas from primary pilot gas regulator 18 resumes supplying the pilot burner flame through pneumatic signal selector 52 through thermo-electric valve 54, and through secondary pilot gas regulator 56.

Thus, when control signal 62 is reduced to about 7 psi burner gas control valve 32 closes and fuel supply to main burner 12 ceases.

As stated above, FIG. 3 is a schematic representation of another embodiment shuttle valve 52, as 2-port manifold, 70, that utilizes check valves, and which may also be utilized as a pneumatic signal selector. Two, 1 psi check valves, 72, and, 74, having opposite gas flow, 76, and, 78, have their inputs, 80, and, 82, in fluid communication (about 25 psi) with thermostatic controller 28, and with (about 7 psi) primary pilot gas regulator 18, respectively, and their outputs, 84, and, 86, in fluid communication with thermo-electric valve 54, through common output, 88. Gas flow 78 is also directed to burner gas control valve 32 through fitting, 92. Plug 94*a* closes off tube, 96, and plugs, 94*b*, and, 94*c*, close off tube 98 as shown in FIG. 3.

Check valves are two-port valves for fluid entry and exit, used for backflow protection by preventing fluid flow in more than one direction. The check valve may be closed by spring action, and when the fluid pressure is greater than the cracking pressure (the minimum specified upstream pressure at which the valve will operate; in the present case, about 1 psi), the valve is opened.

In operation, high-pressure gas supply 16 is regulated by burner gas regulator 20 to send approximately 13 psi to burner gas control valve 32. As set forth above, burner gas control valve 32 will not open unless it receives a pneumatic control signal, 62, from thermostatic controller 28 (2-port manifold 70 responsive to control signal 30 from thermostatic controller 28 to thermo-electric valve 54). Manifold 70, receives two input signals, one from thermostatic controller 28 to check valve 72, and one from pilot gas regulator 18 to check valve 74. Primary pilot gas regulator 18 provides an approximately constant about 7 psi through thermo-electric valve 54 and secondary pilot gas regulator 56, for maintaining a constant pilot flame. The second signal is the on-demand control signal 30 from thermostatic controller 28 responsive to heating requirements. Pneumatic gas regulator 22 supplies about 25 psi to thermostatic controller 28, which can overcome the 7 psi from primary pilot gas regulator 18 to manifold 70 as control signal 30, when directed to do so by thermostatic controller 28. Once the 1 psi to 25 psi (as control signal 30, depending on the demand for heat experienced by thermostatic controller 28 responding to the main burner/heating system requirements) on check valve 72 overcomes the 7 psi on check valve 74 of manifold 70, the output from common output, 88 is directed to thermo-electric valve 54, which when opened by a voltage from thermocouple 58, supplies control signal 62 to open burner gas control valve 32 a chosen amount, as well as supplying gas to retain the flame in pilot burner 14. Secondary pilot gas regulator 56 is provided following thermo-electric valve 54 to render the pressure (approximately 7 psi) in pilot burner 14 immune from the variable pressure from thermostatic controller 28. When thermostatic controller 28 is satisfied, the variable 25 psi signal from thermostatic controller 28 is reduced below about 7 psi, and the original 7 psi signal again continues to supply gas to the pilot burner 14.

Figure 4:
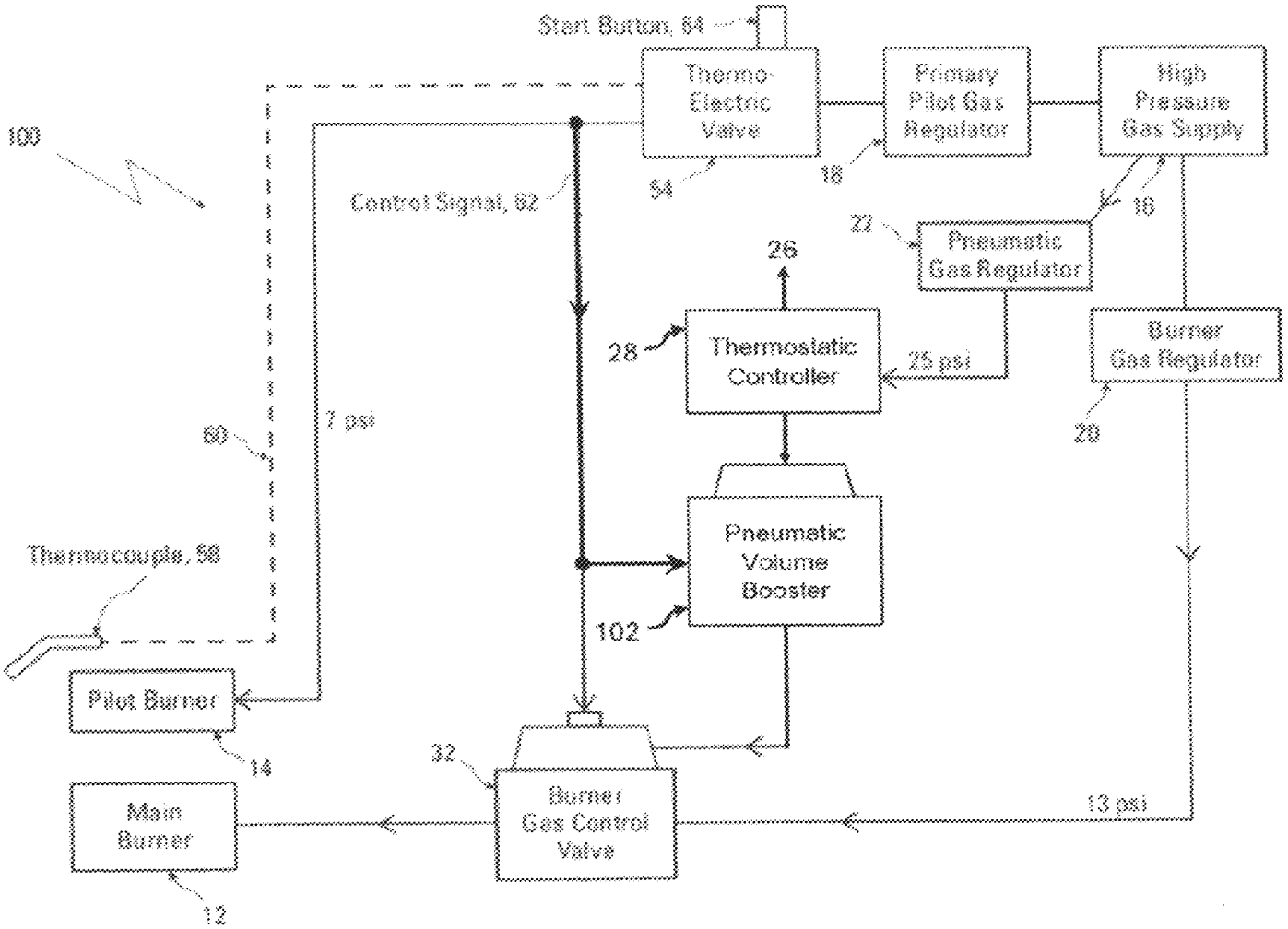
FIG. 4 is a schematic representation of an embodiment of the present apparatus where the pneumatic signal selector or shuttle valve shown in FIGS. 2 and 3 is replaced with a pneumatic volume booster for receiving a pilot control signal or pilot pressure from the thermo-electric valve.

FIG. 4 is a schematic representation of another embodiment, 100, of the present apparatus for interruption of methane flow to process heating systems responsive to flame loss, where pneumatic signal selector or shuttle valve 52 in FIG. 2 is replaced with pneumatic volume booster, 102, that receives pilot control signal or pilot pressure, 62, from thermo-electric valve 54, and a flame in pilot burner 14 is ignited.

A pneumatic volume booster is a pressure regulation device that is controlled by a pilot pressure instead of a spring or adjustment screw. The spring in a pressure regulator normally supplies the mechanical pressure required to open the supply valve until there is a force balance between output pressure and spring force. In a pneumatic volume booster, force is supplied by pilot pressure acting on a diaphragm, for delivering a volume of fluid downstream at a given pilot pressure, or for modulating the output pressure using the pilot pressure in situations where electric signals are not available or desirable.

As seen in FIG. 4, the 7 psi signal provided above diaphragm 66 (FIG. 2) of burner gas control valve 32, from primary pilot gas regulator 18 also provides control signal 62 to pneumatic volume booster 102. Upon receiving control signal 62 from thermoelectric valve 54, pneumatic volume booster 102, directs an about 25 psi signal from the output of thermostatic controller 28 to burner gas control valve 32, thereby pushing upward on diaphragm 66, and opening burner gas control valve 32. If the flame is extinguished at pilot burner 14, thermo-electric valve 54 is closed by a drop in the voltage from thermocouple 58. Once thermo-electric valve 54 closes, control signal 62 to pneumatic volume booster 102 is lost and the pressure beneath diaphragm 66 of burner gas control valve 32 from thermostatic controller 28, which otherwise keeps gas flowing through burner gas control valve 32, is reduced, which extinguishes the flame in main burner 12. It should be noted that pneumatic volume booster 102 is installed following or downstream of thermostatic controller 28. If volume booster 102 is installed upstream of thermostatic controller 28 and volume booster 102 removes the signal from pneumatic gas regulator 22 to thermostatic controller 28, then the signal gas between thermostatic controller 28 and main burner control valve 32 can potentially be trapped with no way to escape if the signal is present and calling for heat. This will leave main burner valve 32 open and permit methane to escape through main burner 12, which is what apparatus 100 is designed to eliminate.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An apparatus for ceasing methane flow from a high-pressure methane source to a gas heating system having an operating temperature, responsive to flame loss of a pilot methane gas burner, comprising:

a pneumatic gas regulator for receiving methane from said high-pressure methane source and providing a first chosen pressure of methane;

a primary pilot gas regulator for receiving methane from said high-pressure methane source and providing a second chosen pressure of methane;

a thermostatic controller for measuring the temperature of said gas heating system, for receiving the first chosen pressure of methane, for providing an output pressure of methane that is equal to or below the second chosen pressure of methane when said gas heating system has a temperature above the operating temperature, and for providing an output pressure of methane above the second chosen pressure when said gas heating system has a temperature equal to or below the operating temperature;

a pneumatic signal selector for receiving the output pressure of methane from said thermostatic controller, and the second chosen pressure of methane from said primary pilot gas regulator, said pneumatic signal selector having an output pressure of methane equal to the larger of the output pressure of methane from said thermostatic controller or the second chosen pressure of methane;

a thermocouple in thermal contact with said pilot methane gas burner, said thermocouple providing a voltage responsive to a temperature generated when said pilot methane gas burner has a flame from burning methane;

a thermo-electric valve for receiving the output pressure of methane from said pneumatic signal selector, for receiving the voltage from said thermocouple, for providing an output pressure of methane equal to the output pressure from said pneumatic signal selector, and for providing a control signal, when the voltage from said thermocouple is responsive to the temperature generated when said pilot methane gas burner has a flame from burning methane;

a secondary pilot gas regulator for receiving the output pressure of methane from said thermo-electric valve, and for providing a third chosen pressure of methane for maintaining the flame of said pilot methane gas burner from burning methane;

a burner gas regulator for receiving methane from said high-pressure methane source, and for providing a fourth chosen pressure of methane;

a burner gas control valve for receiving the output pressure of methane from said pneumatic signal selector, for receiving the second chosen pressure of methane from said primary pilot gas regulator, for receiving the fourth chosen pressure of methane from said burner gas regulator, for receiving the control signal form said thermo-electric valve, and for providing a controlled flow of methane from said burner gas regulator through said burner gas control valve, said burner gas control valve having a diaphragm disposed between a first gas-tight chamber and a second gas-tight chamber, whereby the second chosen pressure of methane presses downward on the diaphragm, and the output pressure of methane from said pneumatic signal selector presses upward on the diaphragm with sufficient force such that a controlled flow of methane is provided when said pilot methane gas burner has a flame from burning methane; and a methane burner for receiving the controlled flow of methane from said burner gas control valve, and for generating heat for said gas heating system.

2. The apparatus of claim 1, wherein said thermo-electric valve comprising a start button for igniting said pilot methane burner.

3. The apparatus of claim 1, wherein said thermostatic controller is vented to atmosphere when providing an output pressure of methane that is equal to or below the second chosen pressure of methane when said gas heating system has a temperature above the operating temperature.

4. The apparatus of claim 1, wherein said pneumatic signal selector is chosen from shuttle valves and manifolds employing check valves.

5. An apparatus for ceasing methane flow from a high-pressure methane source to a gas heating system having an operating temperature, responsive to flame loss of a pilot methane gas burner, comprising:

a pneumatic gas regulator for receiving methane from said high-pressure methane source and providing a first chosen pressure of methane;

a primary pilot gas regulator for receiving methane from said high-pressure methane source and providing a second chosen pressure of methane;

a thermocouple in thermal contact with said pilot methane gas burner, said thermocouple providing a voltage responsive to a temperature generated when said pilot methane gas burner has a flame from burning methane;

a thermo-electric valve for receiving the second chosen pressure of methane, for receiving the voltage from said thermocouple, for maintaining the flame of said pilot methane gas burner from burning methane, for providing an output pressure of methane equal to the second chosen pressure of methane when the voltage from said thermocouple is responsive to the temperature generated when said pilot methane gas burner has a flame from burning methane, and for providing an output pressure of methane lower than the second chosen pressure when said pilot methane gas burner loses its flame;

a thermostatic controller for measuring the temperature of said gas heating system, for receiving the first chosen pressure of methane, for providing an output pressure of methane below the first chosen pressure of methane when said gas heating system has a temperature above the operating temperature, and for providing an output pressure of methane equal to the first chosen pressure when said gas heating system has a temperature equal to or below the operating temperature;

a pneumatic volume booster for receiving the output pressure of methane from said thermostatic controller, and the output pressure of methane from said thermo-electric valve, and for providing an output pressure;

a burner gas regulator for receiving methane from said high-pressure methane source, and for providing a third chosen pressure of methane;

a burner gas control valve for receiving output pressure of methane from said thermo-electric valve, for receiving the third chosen pressure of methane from said burner gas regulator, and for providing a controlled flow of methane from said burner gas regulator through said burner gas control valve, said burner gas control valve having a diaphragm disposed between a first gas-tight chamber and a second gas-tight chamber, whereby the output pressure of methane from said thermo-electric valve presses downward on the diaphragm, and the output pressure of methane from said thermostatic controller presses upward on the diaphragm with sufficient force such that a controlled flow of methane is provided when said pilot methane gas burner has a flame from burning methane; and a methane burner for receiving the controlled flow of methane from said burner gas control valve, and for generating heat for said gas heating system.

6. The apparatus of claim 5, wherein said thermo-electric valve comprises a start button for igniting said pilot methane burner.

7. The apparatus of claim 5, wherein said thermostatic controller is vented to atmosphere when providing an output pressure of methane that is equal to or below the second chosen pressure of methane when said gas heating system has a temperature above the operating temperature.

8. A method for ceasing methane flow from a high-pressure methane source to a gas heating system having an operating temperature, responsive to flame loss of a pilot methane gas burner, comprising:

providing a first chosen pressure of methane, and a second chosen pressure of methane from the high-pressure methane source;

providing a voltage responsive to a temperature of said pilot methane gas burner;

measuring the temperature of the gas heating system;

providing an output pressure of methane that is equal to or below the second chosen pressure of methane when the gas heating system has a temperature above the operating temperature, and providing an output pressure of methane above the second chosen pressure when said gas heating system has a temperature equal to or below the operating temperature;

providing a control signal, when the voltage responsive to the temperature generated by said pilot methane gas burner indicates a flame from burning methane;

providing a third chosen pressure of methane for maintaining the flame of said pilot methane gas burner from burning methane;

providing a fourth chosen pressure of methane from the high-pressure methane source; and providing a controlled flow of methane to the gas heating system, when the pilot methane gas burner has a flame from burning methane, responsive to the second chosen pressure of methane, the fourth chosen pressure of methane, and the control signal.

* * * * *